US007188753B2

(12) United States Patent
Campbell

(10) Patent No.: US 7,188,753 B2
(45) Date of Patent: Mar. 13, 2007

(54) PRESSURE RELEASE CONNECTION AND PNEUMATIC DISPENSING DEVICE

(75) Inventor: David C. Campbell, Bel Air, MD (US)

(73) Assignee: Black & Decker Inc., Newfrey, DE (US)

( * ) Notice: Subject to any disclaimer, the term of this patent is extended or adjusted under 35 U.S.C. 154(b) by 498 days.

(21) Appl. No.: 10/828,103

(22) Filed: Apr. 20, 2004

(65) Prior Publication Data

US 2005/0230433 A1 Oct. 20, 2005

(51) Int. Cl.
*B67D 5/42* (2006.01)

(52) U.S. Cl. ..... 222/389; 222/397

(58) Field of Classification Search ..... 222/389, 222/397, 399, 237, 557, 129, 142.3, 635, 222/258, 261–263, 325–327, 89.1, 497, 394, 222/396

See application file for complete search history.

(56) References Cited

U.S. PATENT DOCUMENTS

| | | | |
|---|---|---|---|
| 2,818,999 | A | 1/1958 | Miller |
| 3,138,303 | A | 6/1964 | Hoveland |
| 3,308,998 | A | 3/1967 | Oppasser et al. |
| 3,568,892 | A | 3/1971 | Burk |
| 3,587,930 | A | 6/1971 | Schultz |
| 3,640,431 | A | 2/1972 | Plumer |
| RE28,120 | E | 8/1974 | Plumer |
| 3,877,610 | A | 4/1975 | Dickey |
| 3,980,209 | A | 9/1976 | Collar |
| 3,983,947 | A | 10/1976 | Wills et al. |
| 3,987,939 | A | 10/1976 | Pedone, Jr. et al. |
| 4,215,802 | A | 8/1980 | Ornsteen |
| 4,284,213 | A | 8/1981 | Lee |

(Continued)

FOREIGN PATENT DOCUMENTS

| | | |
|---|---|---|
| DE | 2036423 | 3/1971 |

(Continued)

OTHER PUBLICATIONS

Brandywine Associates, "Dispensing and Mixing Equipment for Adhesives and Chemicals", www.staticmixerdispenser.com/index, Feb. 10, 2003, 3 page printout.

(Continued)

*Primary Examiner*—Lien M. Ngo
(74) *Attorney, Agent, or Firm*—Harness, Dickey & Pierce, P.L.C.

(57) ABSTRACT

An inlet is adapted to receive pressurized gas from a $CO_2$ gas cartridge. A variable compression member has a normal height, under normal operating temperature conditions, adapted to provide a normal compressive force between the gas cartridge and the inlet to effectively seal the gas cartridge to the inlet. The variable compression member also has a reduced height, under heightened temperature conditions, adapted to provide a reduced compressive force between the gas cartridge and the inlet to allow pressurized gas to escape between the gas cartridge and the inlet. A seal member is compressed between the gas cartridge and the inlet. The inlet may be part of a pneumatic dispensing device. The gas inlet is in fluid communication with a gas enclosure to enable pressurized gas delivered through the inlet to provide a dispensing force on a product cartridge to cause dispensing of the viscous product.

20 Claims, 2 Drawing Sheets

U.S. PATENT DOCUMENTS

| | | | | |
|---|---|---|---|---|
| 4,299,336 | A | 11/1981 | Studer | |
| 4,340,154 | A | 7/1982 | VanManen | |
| 4,349,028 | A * | 9/1982 | Green | 606/143 |
| 4,376,498 | A | 3/1983 | Davis, Jr. | |
| 4,382,530 | A | 5/1983 | Calisto | |
| 4,386,717 | A | 6/1983 | Koob | |
| 4,426,022 | A | 1/1984 | Lang et al. | |
| 4,441,629 | A | 4/1984 | Mackal | |
| 4,453,651 | A | 6/1984 | Braithwaite et al. | |
| 4,461,454 | A | 7/1984 | Vadnais | |
| 4,637,531 | A | 1/1987 | Olsson | |
| 4,685,595 | A | 8/1987 | Segatz | |
| 4,844,301 | A | 7/1989 | Juillet | |
| D303,914 | S | 10/1989 | Hinden et al. | |
| 4,925,061 | A | 5/1990 | Jeromson, Jr. et al. | |
| 4,957,225 | A | 9/1990 | Childers | |
| 4,972,910 | A * | 11/1990 | Fujiki | 169/60 |
| 4,986,444 | A | 1/1991 | Corso | |
| 5,058,769 | A | 10/1991 | Kurtz | |
| D321,309 | S | 11/1991 | Myers | |
| 5,104,013 | A | 4/1992 | Hawley | |
| 5,181,636 | A | 1/1993 | Anderson et al. | |
| 5,203,507 | A | 4/1993 | Matthews | |
| D342,654 | S | 12/1993 | Jens | |
| D343,103 | S | 1/1994 | Bunce | |
| 5,297,697 | A | 3/1994 | Boring | |
| 5,361,941 | A | 11/1994 | Parekh et al. | |
| D357,392 | S | 4/1995 | Kimpel et al. | |
| 5,492,249 | A | 2/1996 | Beach | |
| 5,514,135 | A * | 5/1996 | Earle | 606/93 |
| 5,535,925 | A | 7/1996 | Hinden et al. | |
| 5,556,009 | A | 9/1996 | Motzko | |
| 5,573,148 | A | 11/1996 | Poole et al. | |
| 5,595,327 | A | 1/1997 | Dentler et al. | |
| 5,833,099 | A | 11/1998 | Boaz et al. | |
| 5,887,765 | A | 3/1999 | Broesamle | |
| 6,022,504 | A | 2/2000 | Boaz et al. | |
| 6,032,830 | A | 3/2000 | Brown | |
| 6,039,223 | A | 3/2000 | Damask | |
| 6,062,428 | A | 5/2000 | Callahan | |
| 6,488,180 | B1 | 12/2002 | Bayat | |
| 6,672,489 | B1 | 1/2004 | Huang | |
| 6,935,541 | B1 * | 8/2005 | Campbell et al. | 222/380 |
| 2002/0108971 | A1 | 8/2002 | Lafond | |
| 2002/0145014 | A1 | 10/2002 | Harris | |
| 2004/0074927 | A1 | 4/2004 | Lafond | |

FOREIGN PATENT DOCUMENTS

| | | |
|---|---|---|
| DE | 2944969 | 5/1980 |
| DE | 3409724 | 9/1985 |
| DE | 3526141 | 2/1986 |
| DE | 3526142 | 2/1986 |
| DE | 3920694 | 1/1991 |
| DE | 9419733.4 | 6/1995 |
| EP | 0290259 | 11/1988 |
| GB | 2162902 | 2/1986 |
| GB | 2162903 | 2/1986 |
| JP | 02-144168 | 6/1980 |
| JP | 56-089865 | 7/1981 |
| JP | 62-011571 | 1/1987 |
| JP | 64-038164 | 2/1989 |
| JP | 06-000428 | 1/1994 |
| JP | 06-099122 | 4/1994 |
| JP | 09-024981 | 1/1997 |
| JP | 2001-315864 | 11/2001 |

OTHER PUBLICATIONS

C.R. Laurence Co. Inc. (CRL), "CRL Introduces New Sealant and Caulking Gun Duo"USGlass, Metal & Glazing, Mar. 2110, p. 65.
Essex ARG, "EssexPak System Saves Time and Money", Glass Digest, May 15, 2001, p. 57.
TAH Industries, "Cartridge Systems", www.tah.com/display, Feb. 10, 2003, 1 page printout.

* cited by examiner

PRESSURE RELEASE CONNECTION AND PNEUMATIC DISPENSING DEVICE

FIELD OF THE INVENTION

The present invention relates to pressure release mechanisms; and more particularly, to such mechanisms for use with pressurized gas cartridges.

BACKGROUND OF THE INVENTION

Pressurized gas cartridges are sometimes used as a source of relatively high pressure gas. For example, commonly available $CO_2$ cartridges have been used to provide pressurized gas to a dispensing device for viscous products. Exemplary viscous products include adhesives, caulks and sealants that are sold in product cartridges. The product cartridges typically have a cylindrical wall of cardboard or plastic and a movable piston. The piston is pushed by pneumatic pressure so that product is dispensed from the product cartridge through a dispensing orifice. Such dispensing devices are subject to use under a wide variety of environmental conditions.

In devices that use pressurized gas cartridges as a source of relatively high pressure gas, the gas cartridge is sealed to an inlet to provide fluid communication between the gas cartridge and the inlet. Thus, the relatively high pressure gas is provided to the inlet. As the temperature of the gas cartridge increases, the pressure of the gas within the cartridge can also increase meaningfully. In cases where the temperature increases significantly, the pressure inside the cartridge might be able to increase to the point that it is capable of damaging the device to which the gas cartridge is sealed.

SUMMARY OF THE INVENTION

In accordance with one aspect of the present invention, a pressure release connection for a pneumatic device adapted to be driven by a pressurized gas cartridge is provided. The pressure release connection includes a pressurized gas inlet adapted to receive pressurized gas from the pressurized gas cartridge. A variable compression member is adapted, under normal operating temperature conditions, to provide a normal compressive force between the pressurized gas cartridge and the inlet to effectively seal an outlet of the pressurized gas cartridge to the inlet. The variable compression member is also adapted, under heightened temperature conditions, to provide a reduced compressive force between the outlet of the pressurized gas cartridge and the inlet to allow pressurized gas to escape between the pressurized gas cartridge and the inlet.

In accordance with another aspect of the present invention, a pneumatic dispensing device for dispensing a viscous product is provided. The pneumatic dispensing device is adapted to be driven by a pressurized gas cartridge and includes a gas enclosure adapted to generate a dispensing force on the viscous product from pressurized gas located therein. A pressurized gas inlet is adapted to receive pressurized gas from the pressurized gas cartridge. A seal member is associated with the pressurized gas inlet. A temperature sensitive member is adapted to be associated with the pressurized gas cartridge and has a normal height when subjected to normal operating temperatures that is adapted to force the pressurized gas cartridge against the seal member to effectively seal the pressurized gas cartridge to the inlet. The temperature sensitive member has a reduced height when subjected to heightened temperatures that is adapted to allow the pressurized gas cartridge to move away from the seal member and permit pressurized gas to escape between the pressurized gas inlet and the pressurized gas cartridge. The pressurized gas inlet is in fluid communication with the gas enclosure to enable pressurized gas delivered through the inlet to enter the gas enclosure to cause dispensing of the viscous product from the dispensing device.

In accordance with yet another aspect of the present invention, a pneumatic dispensing device adapted to dispense a viscous product from a viscous product cartridge is provided. The dispensing device is also adapted to be driven by a pressurized gas cartridge. A product cartridge housing component is adapted to retain the viscous product cartridge and to cooperate with the viscous product cartridge to form a gas enclosure separated from a product enclosure by a movable wall. A pressurized gas cartridge housing component has an inlet and a variable compression member opposed from the inlet. The variable compression member is adapted to provide a normal compressive force on the pressurized gas cartridge sufficient to effectively seal the pressurized gas cartridge to the inlet during normal operating temperature conditions. The variable compression member is also adapted to provide a reduced compressive force on the pressurized gas cartridge to permit the release of pressurized gas between the pressurized gas cartridge and the inlet during heightened temperature conditions. A fluid passage provides fluid communication between the inlet and the gas enclosure. Pressurized gas entering the gas enclosure causes a volume of the gas enclosure to expand and a volume of the product enclosure to be reduced to thereby dispense product from the dispensing device.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses. For example, although the device is described herein with respect to commonly available $CO_2$ cartridges, alternative sources of high pressure gas may be used.

As used herein, "pressurized gas cartridge" means a container that is capable of housing a material that can be dispensed from the container in the form of a pressurized gas. Thus, it is possible that the material inside the container is, at least partially, in a form that is not gaseous. Similarly, the phrase "product cartridge" as used herein, means a container capable of housing a product for shipping and/or storage and for dispensing. Thus, the term "cartridge" does not, in itself, require any specific structural configuration.

Figure 1:
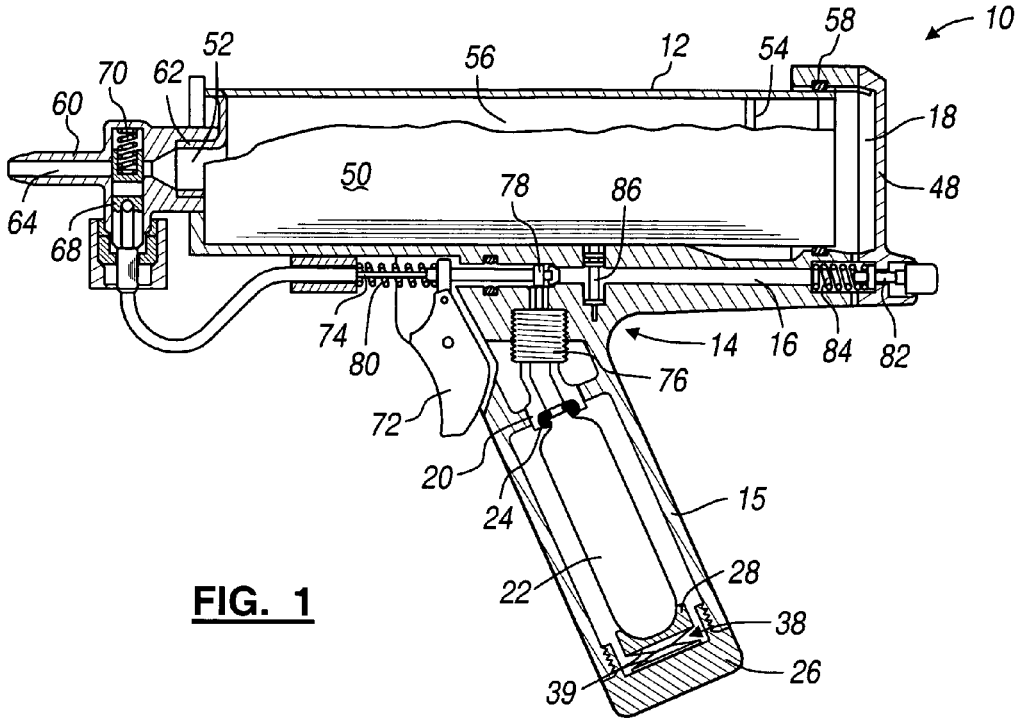
FIG. 1 is a cross-sectional illustration of a preferred embodiment of a pneumatic dispensing device incorporating a preferred pressure release connection.
Figure 6:
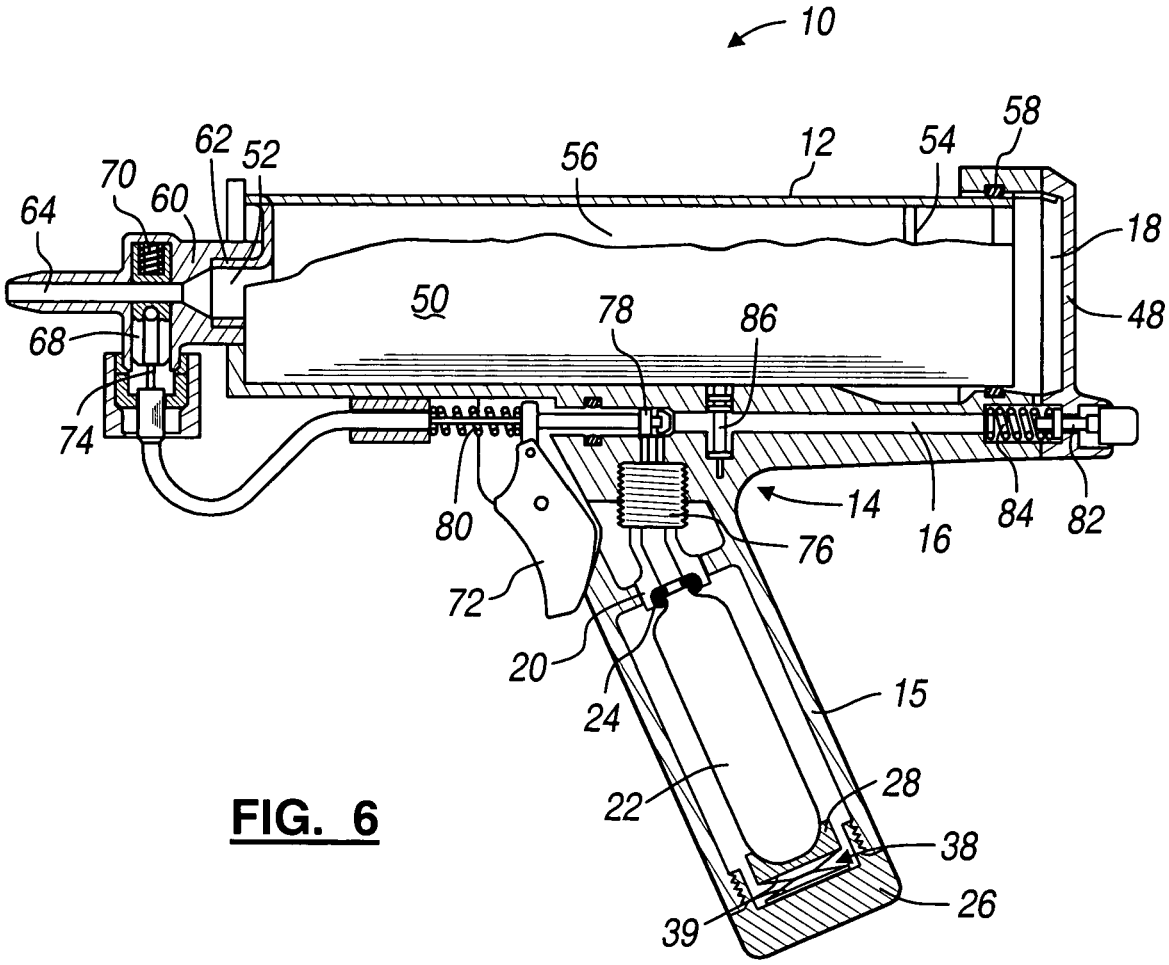
FIG. 6 is a cross-sectional illustration similar to FIG. 1 but with the valve of the dispensing device in a dispensing position.

Referring to FIGS. 1 and 6, one preferred embodiment of a dispensing device 10 for dispensing a viscous product from a viscous product cartridge 12 is illustrated. The dispensing device includes a housing 14. The housing includes a lower portion 15 that operates as a handle for manually grasping the dispensing device 10. In addition, the handle provides a gas cartridge housing component 15. A fluid passage 16 provides fluid communication between a gas enclosure 18 and an inlet 20 associated with the gas cartridge housing component 15. The gas cartridge housing component 15 is adapted to provide a gas cartridge 22 in sealed fluid communication with the inlet 20.

Specifically, the inlet 20 of the fluid passage 16 includes a resilient gasket seal member 24. In addition, the inlet 20 may include a piercing member (not shown) to pierce an opening in the gas cartridge 22 upon sealing to the inlet 20. The gas cartridge housing component 15 includes a screw on cap 26 associated with the gas cartridge 22. The cap 26 includes a seat 28 that accommodates the end of the $CO_2$ cartridge 22. Associated with the $CO_2$ cartridge seat 28 is a temperature sensitive member 38. Under normal operating temperatures the temperature sensitive member 38 has a normal height. When subjected to heightened operating temperatures, the temperature sensitive member 38 has a reduced height.

Under normal operating temperatures, as the cap 26 is threaded onto the remainder of the gas cartridge housing component 15, the cap 26 engages a distal end of the gas cartridge 22 in the seat 28. Continuing to thread the cap 26 onto the remainder of the gas cartridge housing component 15 pushes the gas cartridge 22 into sealing engagement with the inlet 20. In addition, threading the cap 26 onto the remainder of the gas cartridge housing component 15 causes any piercing member to pierce the gas cartridge 22. In any event, sealed fluid communication is provided between the interior of the gas cartridge 22 and the fluid passage 16. The resilient gasket seal member 24 is sufficiently compressed between the inlet 20 and the $CO_2$ cartridge 22 as to effectively seal the pressurized gas cartridge 22 to the inlet 20.

Figure 2:
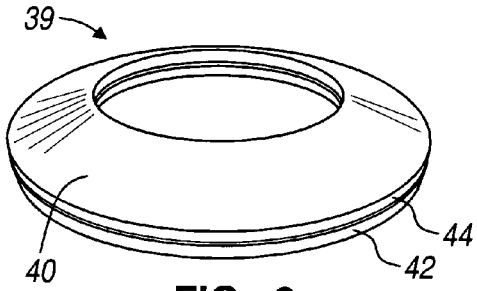
FIG. 2 is a perspective view of one component of the variable compression member of the embodiment of FIG. 1.
Figure 3:
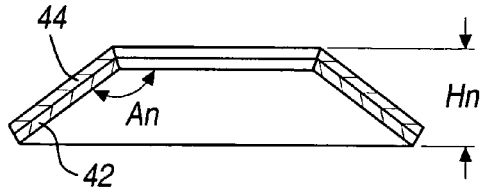
FIG. 3 is a cross-sectional illustration of the component of FIG. 2 when subjected to normal operating temperatures.
Figure 4:
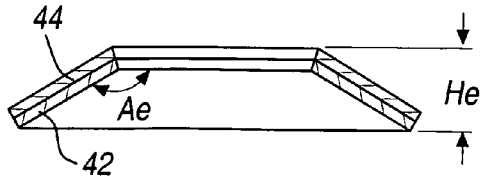
FIG. 4 is a cross-sectional view similar to FIG. 3, but with the variable compression member component being subjected to heightened temperatures.

Referring to FIGS. 2 through 4, the temperature sensitive member 38 of FIG. 1 is made up of a pair of bimetallic components 39 which each have a generally truncated conically shaped annular wall 40. Each bi-metallic component 39 includes a lower layer 42 of material that tends to expand relatively significantly in response to elevated temperatures. An upper layer 44 of material is attached to the lower layer 42 of material. The upper layer 44 is made of a material that has a tendency to expand in response to elevated temperatures that is less than that of the material of the lower layer 42. Preferably, the materials of the upper layer 44 and lower layer 42 are made of metal materials. For example, a suitable metal for forming the upper layer 44 is an alloy of 35% nickel and 65% iron, and a suitable metal for forming the lower layer 42 is an alloy of 72% manganese, 18% copper, 10% nickel.

Referring to FIGS. 3 and 4, each bimetallic component 39 has a normal height Hn (as seen in FIG. 3) when subjected to normal operating temperatures. Upon being subjected to elevated temperatures, however, each bimetallic component 39 has a height He (as seen in FIG. 4) that is less than the normal height Hn. The reduction in height is related to the change in the angle defining the slope of the generally conical wall 40. Specifically, under normal temperatures the conical wall 40 has a normal angle An (as seen in FIG. 3) defining its slope. Upon being subjected to elevated temperatures, each bimetallic component 39 has an angle Ae (as seen in FIG. 4) that is greater than the normal angle An.

The sloped annular wall 40 of each bimetallic component 39 of the temperature sensitive member 38 extends in a direction that has both an axial directional component and a radial directional component. The axial component direction corresponds to the height dimension of the bimetallic component 39 (as seen in the drawings). The radial component corresponds to a direction in a plane that is perpendicular to the axial component. Thus, the use of the terms "axial" and "radial" is not limited to circular bimetallic components 39. The wall 40 extends at an angle with respect to the direction of the compressive force being applied to cause sealing between the pressurized gas cartridge 22 and the inlet 20. Preferably, however, the wall is defined by a cross-sectional shape (for example, as seen in FIGS. 3 and 4) selected from the group consisting of a partial conical shape, a partial spherical shape, a partial parabolic shape and any combination thereof.

As indicated above, under normal operating temperatures the height of the temperature sensitive member 38 is such that when the cap 26 is threaded onto the rest of the housing 14 the cap 26 pushes the cartridge 22 into effective sealing engagement with the inlet 20. Thus, the normal height Hn of each of the bimetallic components 39 of the temperature sensitive member 38 is sufficient to generate a compressive force that effectively seals the $CO_2$ cartridge 22 to the inlet 20. As the temperature increases to a heightened level, the height of the temperature sensitive member 38 decreases. If the temperature increases sufficiently, the reduction in height causes the compressive force on the seal member 24 between the $CO_2$ cartridge and the inlet 20 to decrease to a point that gas can escape at this pressure release connection. Thus, the temperature sensitive member 38 operates as a variable compression member.

Returning now to the dispensing device of FIGS. 1 and 6, the housing includes an upper portion 48 that operates as a product cartridge housing component. This product cartridge housing component 48 is adapted to retain the viscous product cartridge 12. In the illustrated embodiment, the viscous product cartridge 12 is a cylindrical tubular member having a relatively rigid cylindrical wall 50. For example, the cylindrical wall 50 may be formed of cardboard or plastic. Such tubular cartridges 12 are commonly used in conjunction with or in association with construction adhesives, sealants and caulks.

At one end of such cylindrical tubular product cartridge 12 is a dispensing orifice 52. The dispensing orifice 52 may be provided, for example, by cutting the end of a nozzle (not shown) that is typically provided on many such commercially available viscous product cartridges 12. In addition, it may be necessary to rupture an internal seal (not shown) at the base of the nozzle that seals the dispensing orifice 52 and is often also included in such commercially available product cartridges 12. At the opposite end of the product cartridge 12 is a piston 54 that seals the end of the tube 12. The piston 54 operates as a movable wall that is capable of forcing product from a product enclosure 56 through the dispensing orifice 52 as the piston 54 moves toward the dispensing orifice 52.

As indicated above, the upper portion of the housing 14 operates as a product cartridge housing component 48. The product cartridge housing component 48 is adapted to cooperate with the viscous product cartridge 12 to form the gas enclosure 18 separated from the product enclosure 56 by the movable piston 54. In this embodiment, the product cartridge housing component 48 of the housing 14 is sealed to the cylindrical outer wall 50 of the product cartridge 12 using an O-ring 58 to form the gas enclosure 18 between the housing 14 and the product cartridge 12. The piston 54 or movable wall separates the gas enclosure 18 from the product enclosure 56 formed inside the product cartridge 12.

Although this embodiment has a relatively rigid cylindrical wall 50 and a movable piston 54, an alternative product cartridge (not shown) is made of flexible thin-film packaging material. The corresponding product cartridge housing component is modified to be sealed around the flexible side walls in this alternative embodiment providing a gas enclosure that surrounds the flexible side walls. Thus, the side walls can move toward each other under external pressure within the gas enclosure to force product through the dispensing orifice. Accordingly, the flexible thin-film side walls provide the movable walls in this alternative embodiment.

Returning to the embodiment of FIGS. 1 and 6, the upper portion of the housing 14 also includes a nozzle housing component 60 which is adapted to seal with a wall 62 of the product cartridge 12 that surrounds the dispensing orifice 52. As indicated above, this wall 62 can be provided by trimming the end of a nozzle (not seen) from a standard caulk or adhesive product cartridge. A rubberized gasket (not seen) may be provided between the nozzle housing component 60 and the wall 62 of the product cartridge 12 to facilitate this seal. As another possible alternative, threads (not shown) may be provided to enable threaded engagement between the wall 62 of the product cartridge 12 and the nozzle housing component 60 to facilitate the seal therebetween.

The nozzle housing component 60 includes a dispensing passage 64 which is selectively opened and closed by a valve body 68. A spring 70 biases the valve body 68 downwardly into a closed position in which the dispensing passage 64 of the nozzle 60 is sealed as seen in FIG. 1. Actuation of a manually operated trigger 72 causes a cable 74 to counteract the biasing force of the spring 70 and push the valve body 68 upwardly into a dispensing or open position as see in FIG. 6. In this open position, product can be dispensed from the product cartridge 12 through the dispensing orifice 62 of the product cartridge 12 and through the dispensing passage 64 of the nozzle housing component 60.

In an alternative embodiment (not seen), the nozzle, including the valve body and dispensing passage, may be integrally provided as part of the product cartridge, rather than as part of the housing. This configuration eliminates the need to seal the dispensing orifice of the product cartridge and the dispensing passage of the dispenser housing together. In contrast, the preferred embodiment described above enables re-use of the nozzle and valve assembly with multiple disposable product cartridges.

Returning to the embodiment of FIGS. 1 and 6, a pressure regulator 76 is located along the fluid passage 16, downstream of the inlet 20. The pressure regulator 76 reduces the pressure of the pressurized gas flowing from the pressurized $CO_2$ gas cartridge 22 to a lower level. This lower level of pressure is high enough to drive product from the product cartridge 12 at a desirable rate. Thus, the pressure regulator 76 receives gas from the fluid passage 16 at a relatively high pressure at an inlet side facing toward the $CO_2$ cartridge 22 and, after converting the gas to a reduced pressure, discharges the $CO_2$ gas from an outlet side of the pressure regulator into the fluid passage 16 toward the gas enclosure 18.

A gas flow control valve 78 is also located along the fluid passage 16. The gas flow control valve 78 is biased to a closed position by a spring 80. The gas flow control valve 78 is manually actuated by the trigger 72 which moves the valve 78 to an open position as seen in FIG. 6. In the open position, gas is permitted to travel along the passage 16 from the pressurized $CO_2$ cartridge 22 to the gas enclosure 18. The resulting increase in gas within the gas enclosure 18 causes the pressure to increase until the piston 54 begins to move.

As indicated above, the trigger 72 is also connected to the nozzle valve body 68 to open the valve upon manual actuation. Thus, in this embodiment, the valve 68 of the dispensing passage 64 and the gas flow valve 78 are simultaneously opened. As the piston 54 begins to move, the volume of the gas enclosure 18 expands reducing the volume of the product enclosure 56 and dispensing product through the dispensing orifice 52 and the dispensing passage 64. Upon release of the trigger 72, both the dispensing valve 68 and the gas flow control valve 78 move to their closed positions as seen in FIG. 1. Thus, the product within the product enclosure 56 is maintained under pressure due to the remaining gas pressure within the gas enclosure 18. Product does not continue to be dispensed, however, due to the valve 68 of the dispensing passage 64 being in a closed position.

Two additional valve mechanisms are located within the fluid passage 16 in this embodiment. One is a pressure release valve 82 that is additionally associated with the gas enclosure 18 and is biased to a closed position by a spring 84. The pressure release valve 82 may be manually moved to an open position to permit the release of gas pressure from the gas enclosure 18. This release of pressure can, for example, facilitate the replacement of the viscous product cartridge 12. A maximum pressure release valve 86 is also included in the fluid passage 16 that is designed to vent the $CO_2$ gas from the gas enclosure 18 should the pressure therein exceed a maximum pressure level.

Operation of the dispensing device 10 described above involves locating a product cartridge 12 in the product cartridge retaining housing component 48. As described above, this creates a gas enclosure 18 separated from a product enclosure 56 by a moveable wall 54. In addition, operation of the dispensing device involves locating a $CO_2$ cartridge 22 inside the gas cartridge housing component 15 of the housing 14. Thus, as described above, the interior of the $CO_2$ cartridge 22 is located in sealed fluid communication with the fluid passage 16 by screwing on the cap 26.

Application of a product dispensing force is accomplished by manually actuating the trigger 72 which causes opening of both the nozzle valve 68 and gas flow control valve 78. Pressurized gas from the $CO_2$ cartridge 22 flows through the fluid passage 16 and passes through the pressure regulator 76 where the pressure level of the gas is reduced to an operational pressure. This pressure is selected to affect a desirable dispensing rate without unnecessarily increasing the pressure. A preferred typical operational pressure is from about 20 psi to about 50 psi. An adjustment mechanism (not shown) for the pressure regulator 76 may additionally be provided to enable a user to adjust the operating pressure level for different products.

The pressurized gas flows past the open gas flow control valve 78 in the fluid passage 16 and into the gas enclosure 18 to dispense product as described above. Upon release of the trigger 72, the gas flow control valve 78 closes to cause the flow of gas from the $CO_2$ cartridge 22 into the gas enclosure 18 to cease. In addition, the nozzle valve 68 closes which causes the flow of product through the dispensing passage 64 to cease. Thus, a relatively large amount of pressurized gas remains in the cartridge 22. When subjected to normal operating temperatures, the cartridge 22 is effectively sealed to the inlet 20 due to the force applied to the distal end of the gas cartridge 22 by the temperature sensitive component 38. Upon exposing the dispensing device 10 to elevated temperatures, however, the compressive force on the seal 24 between the inlet 20 and the pressurized gas cartridge 22 is reduced due to a reduction in the height of the temperature sensitive member 38 as described above. This reduction in height and related compressive force is preferably such that gas from the $CO_2$ cartridge 22 is allowed to escape in a controlled manner. As used herein, the release of gas is "controlled" if it does not cause the $CO_2$ cartridge to become completely dislodged from the inlet 20 and/or otherwise cause damage to the device 10.

Figure 5:
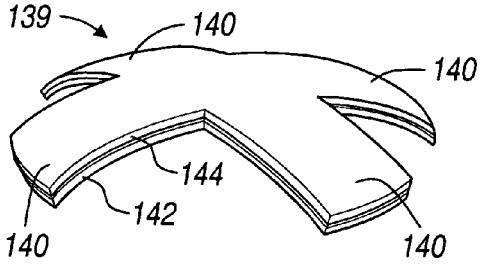
FIG. 5 is a perspective view of an alternative embodiment of a variable compression member component.

Referring to FIG. 5, many alternative shapes of bimetallic components 139 are capable of use as a temperature sensitive member 38. For example, although the temperature sensitive member 38 of FIG. 1 is formed by combining two bi-metallic components 39, a plurality of bimetallic components may make up an alternative temperature sensitive member. Alternatively, a single bimetallic component may define the temperature sensitive member.

For example, the alternative bimetallic component 139 illustrated in FIG. 5 can be used alone in place of the multi-component temperature sensitive member 38 of FIG. 1 or may be used in combination with additional bimetallic components. This bimetallic component 139 has several partially spherical shape walls 140 which together form a generally "X" shape. Since each of the walls 140 are partially spherical, they each extend in a direction that has both an axial component and a radial component as discussed above. In addition, each of the walls includes an upper layer 144 of material and a lower layer 142 of a second material. The materials of the upper and lower layers have the temperature sensitive properties described above. In fact, the bi-metallic component 139 has essentially all the same functional and structural aspects as discussed above with respect to the bi-metallic component 39 of FIG. 2.

Only a small number of the many possible alternatives are described above. Many additional modifications and alternatives beyond those described above, may be envisioned by those skilled in the art. For example, a pair of bimetallic components may be joined together at their outer peripheries, rather than at their inner ends as illustrated in FIG. 1. In addition, the housing 14 may be formed from a gas cartridge housing component 15 and a product cartridge housing component 48 that are each formed as separate parts and then subsequently joined together. Thus, the term "component" as used herein does not, in itself, imply it is a separate part. Further, any reference to the terms "first", "second", etc. is only intended to differentiate between two similarly named items. Thus, use of these terms does not imply any order of importance or other significance.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A pressure release connection for a pneumatic device adapted to be driven by a pressurized gas cartridge, the pressure release connection comprising:

a pressurized gas inlet adapted to receive pressurized gas from the pressurized gas cartridge; and a variable compression member being adapted, under normal operating temperature conditions, to provide a normal compressive force between the pressurized gas cartridge and the inlet to effectively seal an outlet of the pressurized gas cartridge to the inlet, and being adapted, under heightened temperature conditions, to provide a reduced compressive force between the outlet of the pressurized gas cartridge and the inlet to allow pressurized gas to escape between the pressurized gas cartridge and the inlet.

2. A pressure release connection according to claim 1, further comprising a seal member located between the pressurized gas inlet and the outlet of the pressurized gas cartridge.

3. A pressure release connection according to claim 1, wherein the variable compression member has a height that is reduced upon exposure to heightened temperature conditions.

4. A pressure release connection according to claim 1, wherein the variable compression member has a first layer made of a first metal and a second layer made of a second metal.

5. A pressure release connection according to claim 1, wherein the variable compression member comprises a plurality of separate components, each component having a first layer made of a first metal and a second layer made of a second metal.

6. A pressure release connection according to claim 1, wherein the variable compression member is adapted to be associated with an end of the pressurized gas cartridge that is generally opposite the outlet of the pressurized gas cartridge.

7. A pressure release connection according to claim 1, wherein the variable compression member comprises a wall that extends in a direction that has both an axial directional component and a radial directional component.

8. A pneumatic dispensing device for dispensing a viscous product, the pneumatic dispensing device being adapted to be driven by a pressurized gas cartridge, the pneumatic dispensing device comprising:

a gas enclosure adapted to generate a dispensing force on the viscous product from pressurized gas located therein;

a pressurized gas inlet adapted to receive pressurized gas from the pressurized gas cartridge, a seal member associated with the pressurized gas inlet; and a temperature sensitive member adapted to be associated with the pressurized gas cartridge and having a normal height when subjected to normal operating temperatures that is adapted to force the pressurized gas cartridge against the seal member to effectively seal the pressurized gas cartridge to the inlet, the temperature sensitive member having a reduced height when subjected to heightened temperatures that is adapted to allow the pressurized gas cartridge to move away from the seal member and permit pressurized gas to escape between the pressurized gas inlet and the pressurized gas cartridge;

wherein the pressurized gas inlet is in fluid communication with the gas enclosure to enable pressurized gas delivered through the inlet to enter the gas enclosure to cause dispensing of the viscous product from the dispensing device.

9. A pneumatic dispensing device according to claim 8, wherein the temperature sensitive member comprises a wall that extends in a direction that has both an axial and a radial component.

10. A pneumatic dispensing device according to claim 9, wherein the wall has a first layer made of a first material having a first temperature expansion rate and a second layer made of a second material having a second temperature expansion rate that is greater than the first temperature expansion rate.

11. A pneumatic dispensing device according to claim 8, wherein the temperature sensitive member comprises a plurality of separate components joined together, each component having a wall that extends in a direction that has both an axial and a radial component.

12. A pressure release connection according to claim 8, wherein, prior to sealing the inlet and the outlet together, the seal member is attached to one of the inlet and the outlet.

13. A pressure release connection according to claim 8, wherein the temperature sensitive member has a wall defined by a cross-sectional shape selected from the group consisting of a partial conical shape, a partial spherical shape, a partial parabolic shape and any combination thereof.

14. A pressure release connection according to claim 8, wherein the temperature sensitive member is adapted to be associated with an end of the pressurized gas cartridge that is generally opposite the outlet of the pressurized gas cartridge.

15. A pneumatic dispensing device adapted to dispense a viscous product from a viscous product cartridge, the dispensing device also being adapted to be driven by a pressurized gas cartridge, the dispensing device comprising:

a product cartridge housing component adapted to retain the viscous product cartridge and to cooperate with the viscous product cartridge to form a gas enclosure separated from a product enclosure by a movable wall;

a pressurized gas cartridge housing component having an inlet and a variable compression member opposed from the inlet, the variable compression member being adapted to provide a normal compressive force on the pressurized gas cartridge sufficient to effectively seal the pressurized gas cartridge to the inlet during normal operating temperature conditions, and being adapted to provide a reduced compressive force on the pressurized gas cartridge to permit the release of pressurized gas between the pressurized gas cartridge and the inlet during heightened temperature conditions;

a fluid passage providing fluid communication between the inlet and the gas enclosure;

wherein pressurized gas entering the gas enclosure causes a volume of the gas enclosure to expand and a volume of the product enclosure to be reduced to thereby dispense product from the dispensing device.

16. A pressure release connection according to claim 15, further comprising a seal member located between the pressurized gas inlet and an outlet of the pressurized gas cartridge.

17. A pressure release connection according to claim 15, wherein the variable compression member has a height that is reduced upon exposure to heightened temperature conditions.

18. A pressure release connection according to claim 15, wherein the variable compression member has a first layer made of a first metal and a second layer made of a second metal.

19. A pressure release connection according to claim 15, wherein the variable compression member comprises a plurality of separate components, each component having a first layer made of a first metal and a second layer made of a second metal.

20. A pressure release connection according to claim 15, wherein the variable compression member comprises a wall defined by a cross-sectional shape selected from the group consisting of a partial conical shape, a partial spherical shape, a partial parabolic shape and any combination thereof.

* * * * *